US006332419B1

(12) United States Patent
Ku

(10) Patent No.: US 6,332,419 B1
(45) Date of Patent: Dec. 25, 2001

(54) AUXILLARY DEVICE OF A SEWING MACHINE

(76) Inventor: Fei-Lung Ku, No. 10, Alley 6, Lane 148, Kai Yaun Road, Tainan (TW)

( * ) Notice: Subject to any disclaimer, the term of this patent is extended or adjusted under 35 U.S.C. 154(b) by 0 days.

(21) Appl. No.: 09/811,597

(22) Filed: Mar. 20, 2001

(51) Int. Cl.[7] ..... D05B 1/08; D05B 65/00
(52) U.S. Cl. ..... 112/293; 112/163; 112/253
(58) Field of Search ..... 112/302, 253, 112/286, 163, 165, 293, 295

(56) References Cited

U.S. PATENT DOCUMENTS 4,550,672 * 11/1985 Kastrup ..... 112/293
5,025,739 * 6/1991 Inoue ..... 112/286
5,027,732 * 7/1991 Sato et al. ..... 112/253 X
5,127,350 * 7/1992 Okada et al. ..... 112/163
5,367,969 * 11/1994 Nonaka ..... 112/295
5,722,338 * 3/1998 Douyasu ..... 112/165

* cited by examiner

*Primary Examiner*—Ismael Izaguirre
(74) *Attorney, Agent, or Firm*—Rosenberg, Klein & Lee

(57) ABSTRACT

An auxiliary device of a sewing machine capable of making three net-like stitches has two clipping members connected to each other. A hooked plate is movably passed through between the clipping members to pull a first kind of threads for same to hold in position. The front ends of the clipping members are disposed under a curved hook of a thread guide, and relatively close to needles of the first threads such that, in sewing operation, the first threads can be connected with a net thread controlled by the thread guide and a shuttle to form the net-like stitch without possibility of the first threads falling off the clipping members and failing to connect the net thread.

6 Claims, 20 Drawing Sheets

(9 of 20 Drawing Sheet(s) Filed in Color)

AUXILLARY DEVICE OF A SEWING MACHINE

BACKGROUND OF THE INVENTION

The present invention relates to an auxiliary device of a sewing machine, capable of making three straight stitches and a net-like stitch and particularly to one which can help the net-like stitch securely formed on the cloth at the beginning of the sewing.

Referring to FIGS. 7 and 8 and 9, a conventional sewing machine capable of making three straight stitches and a net-like stitch on a cloth has a needle holder 5, three needles 51 secured to the needle holder 5, and a pressing member 57 provided to press the cloth. The sewing machine further has a lower shuttle needle (not shown) for a net thread to make a net-like stitch and three straight stitches (as shown in FIG. 10) together with the three upper needles 51 on the bottom of the cloth.

To make the above sewing machine capable of working more efficiently, a lower thread cutting device 55 (FIG. 11) is fitted under the flat-bed such that the threads 511 can be cut off automatically at the end of the sewing.

Moreover, referring to FIG. 9, a thread hooking device 54 is fitted to screw holes 512 of the sewing machine; the thread hooking device (FIGS. 13 and 14) was invented by the inventor of the present invention, and patented by R.O.C Intellectual Property Office with patent no. 286691 on Sep. 21, 1996. The hooking device 54 has a hooking plate 541, and an elastic plate 542 which can clip the ends 510 of the threads cut off by the lower thread cutting device 55 for permitting the ends 510 of the threads to be covered by stitches of the next sewing.

However, the above sewing machine can't make net-like stitches on both the upper side and the lower side of a cloth as shown in FIG. 15. To make two side net-like stitches, a shuttle 52 has to be fitted to the sewing machine, and the thread hooking device 54 removed, and a thread guide support 53 (FIGS. 16 and 17) is fitted to the screw holes 512 instead. The upper net thread 531 is passed through a curved hole 532 of the thread guide support 53. Thus, the upper net thread 53 can be made into upper net-like stitches by means of the shuttle 52. The sewing machine capable of making two-side net-like stitches is found to have a disadvantage that three of more lower side net-like stitches would fail to form at the beginning of sewing as shown in FIGS. 17 and 18 because, referring to FIG. 14, when the threads 511 are cut off, the distance L between the right one of the needles 51 and the end 543 of the hooking plate 541 is relatively long as compared with the length (4~5 mm) of the ends of the threads 51 inserted into between the looking plate 541 and the elastic plate 542. Consequently, the ends of the threads 51 would separate from the hooking device 54 easily at the beginning of sewing, resulting in the net-like stitches falling to form at the beginning.

Another conventional sewing machine capable of making three straight stitches and a net-like stitch on each side of a cloth has upper thread cutting device 56 besides the upper shuttle 52 and the thread guide support 53; referring to FIGS. 16 and 17, the upper thread cutting device 56 cuts off the upper net thread 531, and hold the end of the same automatically at the end of a sewing. However, the ends 510 of the threads 511 for the straight stitches are not held by any clipping device when the threads 511 are cut off by the lower thread cutting device 55, so the operator of the sewing machine has to move the ends 510 rearwards with his hands such that the threads 511 are disposed between the pressing member 57 and the cloth. Otherwise, the upper net thread 531 would fail to form upper net-like stitch because the threads 511 are not disposed in a right position; when the threads 511 are disposed correctly, in the downward movement of the needles 51, the upper net thread 531, guided by the thread guide support 53, will locate between the first thread 511 (the right one) and the right one of the needles 51; thus, the upper net thread 531 can be made into net shape by the upper shuttle 52 and the thread guide support 53, and secured to the cloth by the threads 511 as shown in FIG. 18.

From the above description of the second conventional sewing machine, we can see that the sewing process is not efficient because the worker has to put the ends 510 of the threads 511 at the right position at the beginning of every sewing. Consequently, the cost is relatively high. Referring to FIG. 19, to overcome the above inconvenience, many clothes are fed to the sewing machine one after another such that the worker doesn't have to move the ends 510 of the threads 511 every time. However, the workers still have to cut off the threads between the clothes with a scissors afterwards, a waste of labor time.

From the above description, it can be understood that the conventional sewing machines have disadvantages as follows:

1. To make net-like stitches on two sides of a cloth, the sewing machine has to be equipped with the thread guide support, and the upper thread hooking device removed, i.e. the factories have to remove and install the auxiliary devices frequently for different orders placed by the customers. A small factory can't afford to hire a technician so the workers have to do the installation, resulting in problem of calibration. If the small factory sends for a technician for the installation, the cost is high, and it is a waste of time.

2. The workers have to spend much time in putting the ends 510 of the threads 511 in a right position for permitting a upper net-like stitch to be formed. And, referring to FIG. 18, relatively long end portions of the threads 511 would be left on the cloth.

SUMMARY OF THE INVENTION

Therefore, it is a main object of the present invention to provide an auxiliary device for a sewing machine capable of making a net-like stitch on each side of a cloth such that the upper net-like stitch can be securely formed on the cloth without the problems as described in the Background.

It is another object of the present invention to provide an auxiliary device for a sewing machine such that the factories don't have to frequently change parts for making two-side net-like stitches on a cloth, i.e. the auxiliary device is always fitted to the sewing machine and suitable for making both two-side net-like stitches and one-side stitch.

The auxiliary device of a sewing machine includes an upper clipping plate; the upper clipping plate is connected to a lower clipping member with a hooked plate movably inserted between a clipping end portion of the upper clipping plate and a clipping end portion of the lower clipping member.

The hooked plate can pull three first kind of threads into between the clipping end portions for same to be hold by the clipping end portions when the first threads are cut off from a cloth to be sewed with net-like stitch.

The clipping end portions are disposed relatively close to needles of the first threads, and under a curved hooked portion of a thread guide of a net thread provided for making the net-like thread such that the first threads won't fall off the clipping end portions when the needles of the first threads move down in sewing; the curved end portion of the thread guide is provided to support the net thread for same to be placed on the cloth with suitable shape by an upper shuttle.

The length of the ends of the first threads held between the clipping upper plate and the lower clipping member is about three to four centimeters, long enough to present the threads from falling off the clipping end portions to wrong position where a few units of the net-like stitches would fail to form.

To make only one-side net-like stitch, the net thread provided for making upper net-like stitch is removed from the upper shuttle and the thread guide, i.e. no parts have to be removed or installed in adjusting the sewing machine for different orders of products.

BRIEF DESCRIPTION OF THE DRAWINGS

The file of this patent contains at least one drawing executed in color photographs. Copies of this patent with the color photographs will be provided by the U.S. Patent and Trademark Office upon request and payment of the necessary fee.

This invention will be better understood by referring to the accompanying drawings, wherein.

DETAILED DESCRIPTION OF THE PREFERRED EMBODIMENT

Figure 1:
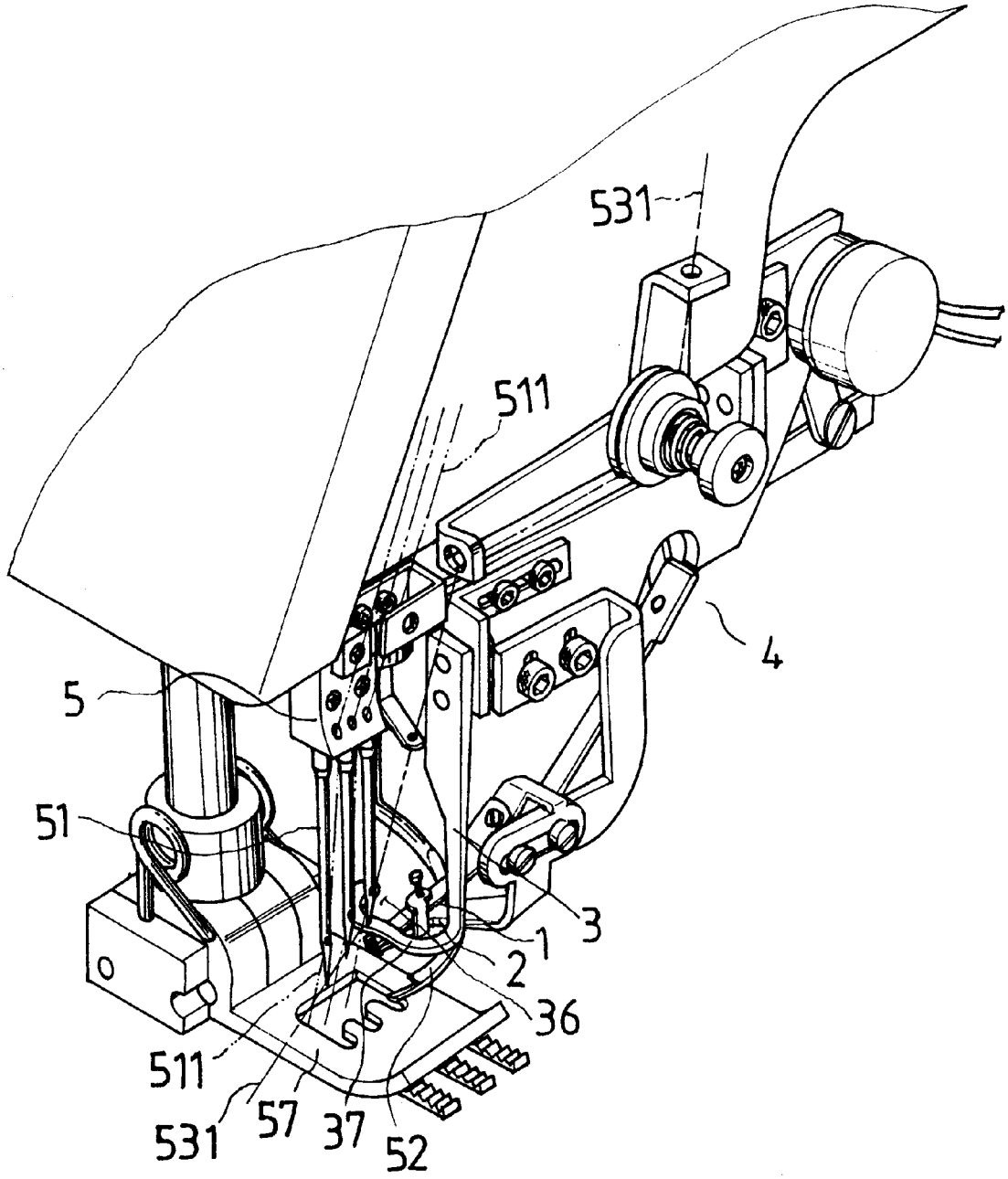
FIG. 1 is a fragmentary perspective view of a sewing machine with the auxiliary device of the present invention.
Figure 2:
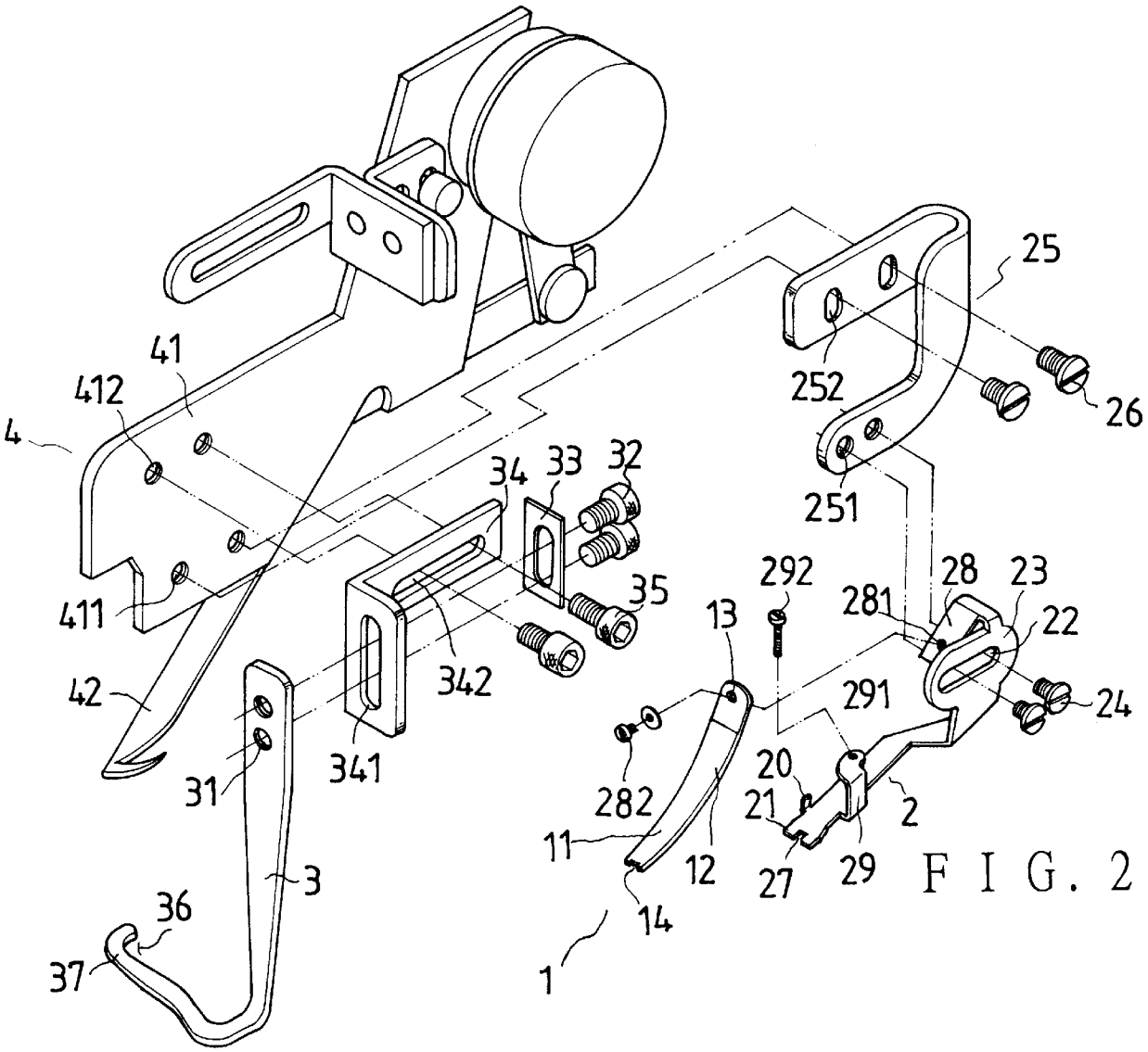
FIG. 2 is an exploded perspective view of the auxiliary device of a sewing machine of the present invention.
Figure 4:
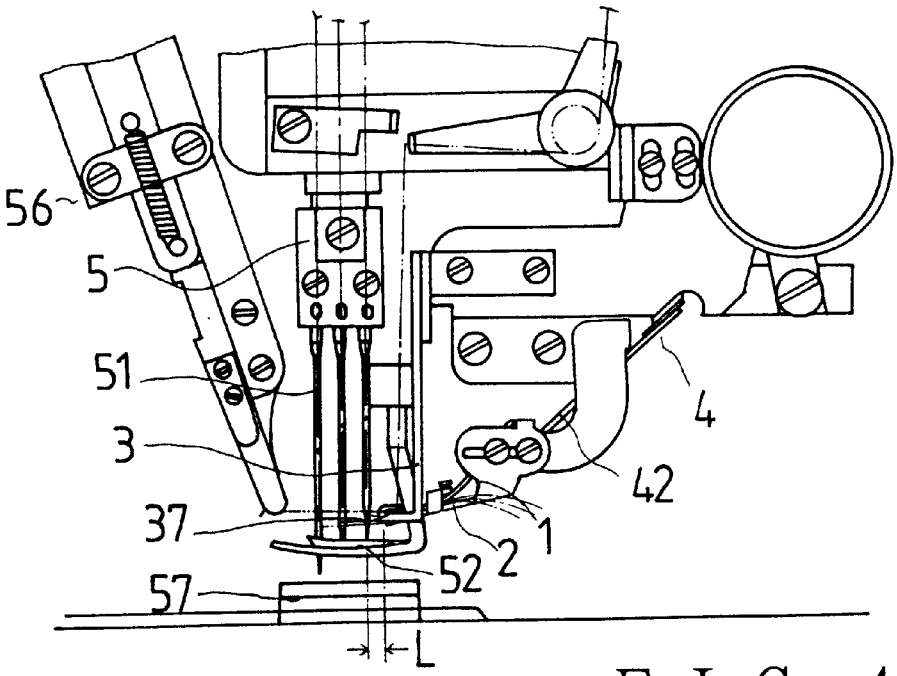
FIG. 4 is a fragmentary front view of the sewing machine with the auxiliary device of the present invention under operation.
Figure 3:
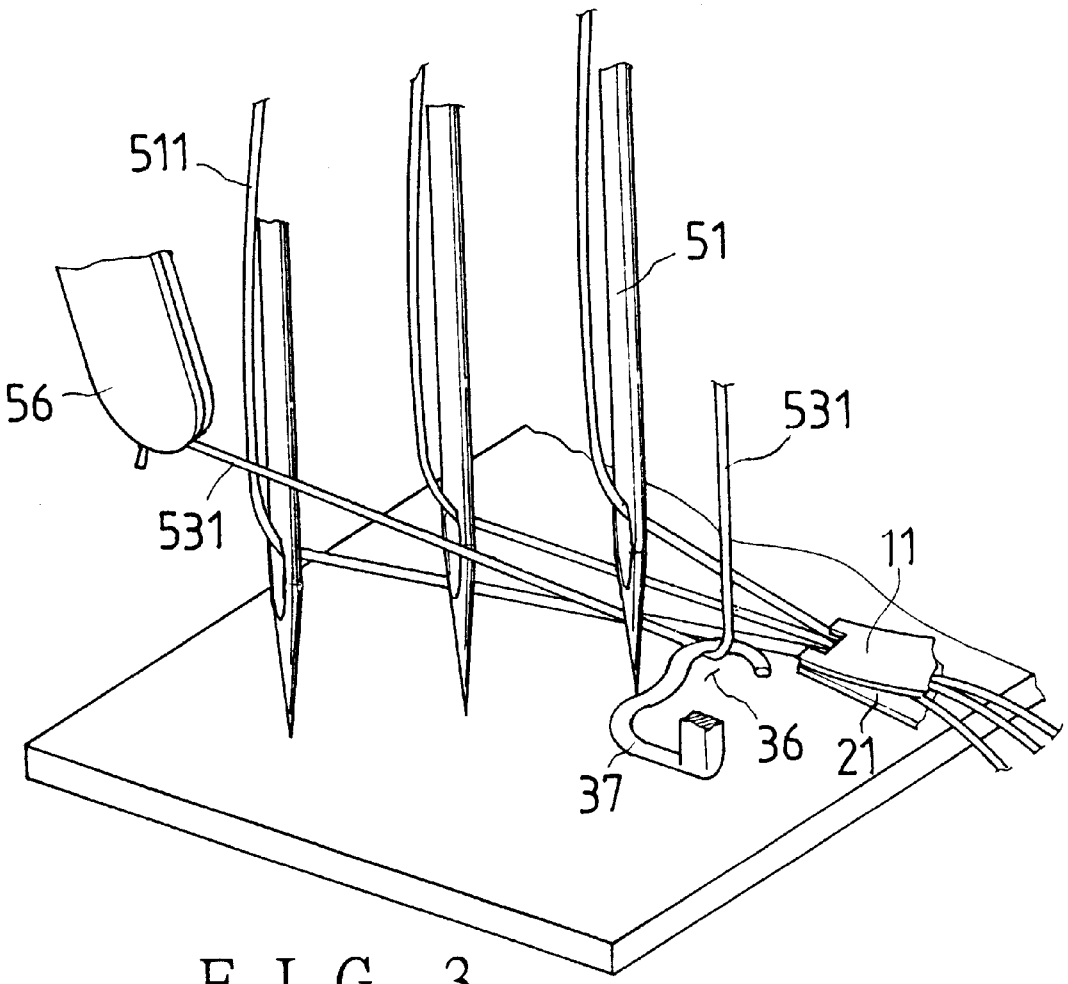
FIG. 3 is a fragmentary perspective view of the sewing machine according to the present invention.

Referring to FIGS. 1 and 2, an auxiliary device of a sewing machine of the present invention has an upper clipping plate 1, a lower clipping member 2, a locating member 25 and a thread hooking device 4.

The upper clipping plate 1 has a front clipping end portion 11, a curved portion 12, a hole 13 at a rear end and a confining gap 14 at the front end of the clipping end portion 11. The lower clipping member 2 has a first connecting end portion 23, a second connecting portion 28 disposed beside the first connecting end portion 23, and an elongated plate having a clipping end portion 21; the elongated plate projects from a lower part of the first connecting end portion 23, and has a confining protrusion 20, and a bent plate 29 sticking up from two sides. The clipping end portion 21 has a confining gap 27 at a front end. The second connecting portion 28 has a screw hole 281, and the first connecting end portion 23 has an elongated hole 22.

The upper clipping plate 1 is connected to the second connecting portion 28 by means of a screw 282 screwed into the hole 13 and the screw hole 281 of the second connecting portion 28; thus, the upper clipping plate 1 contacts the upper side of the clipping end portion 21 of the lower clipping member 2 with the confining gaps 14 and 27 facing each other.

Furthermore, an adjustment screw 292 is screwed through a screw hole 291 of the bent plate 29 to abut the upper clipping plate 1 such that the tightness of the space between the clipping end portion 11 and 21 can be adjusted by means of the adjustment screw 292.

The lower clipping member 2 is connected to the locating member 25 by means of a screw 24 screwed through the elongated holes 22 of the lower clipping member 2 and screw holes 251 of the locating member 25.

The auxiliary device is connected to the thread hooking device 4 by means of screws 26 screwed through the screw holes 252 of the locating member 25 and the screw holes 412 of the connecting plate 41 of the thread hooking device 4. The connecting plate 41 further has a screw holes 411 below the screw holes 412. The thread hooking device 4 has a hooked plate 42 movably received between the upper clipping plate 1 and the lower clipping member 2.

A thread guide 3 is connected to the connecting plate 41 of the thread hooking device 4; the thread guide 3 is connected to an angle plate 34 by means of screws 32 screwed through upper screw holes 31 thereof and an elongated hole 341 of the angle plate 34; a washer 33 is disposed between the heads of the screws 32 and the angle plate 34; the angle plate 34 is connected to the connecting plate 41 by means of screws 35 screwed through an elongated hole 342 thereof and the screw holes 412 of the connecting plate 41.

The thread guide 3 further has a curved hook portion 37 and a gap 36 adjacent to an inner side of the curved hook portion 37.

Figure 5:
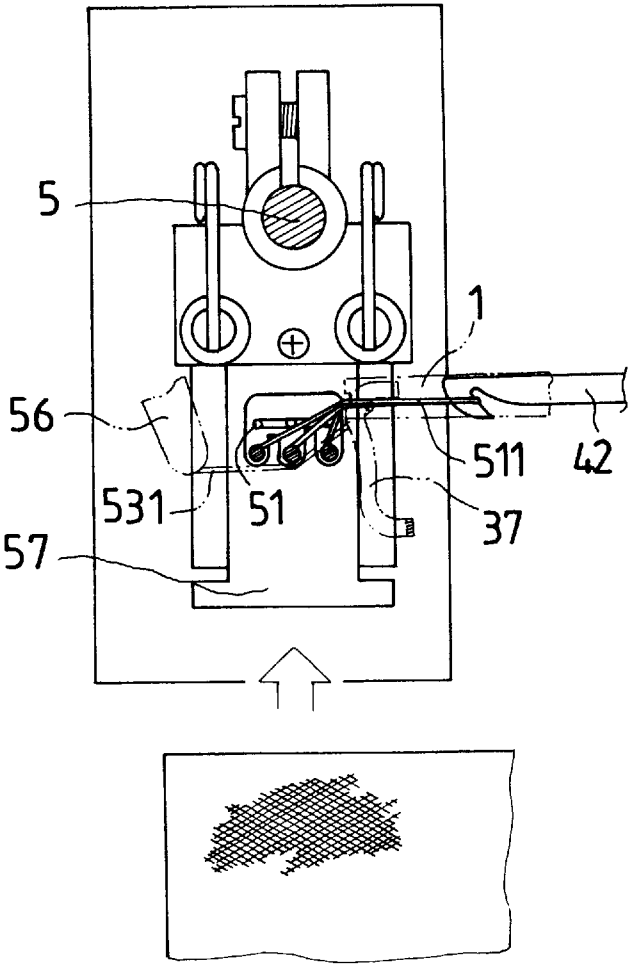
FIG. 5 is a fragmentary top view of the sewing machine with the auxiliary device of the present invention under operation.
Figure 6:
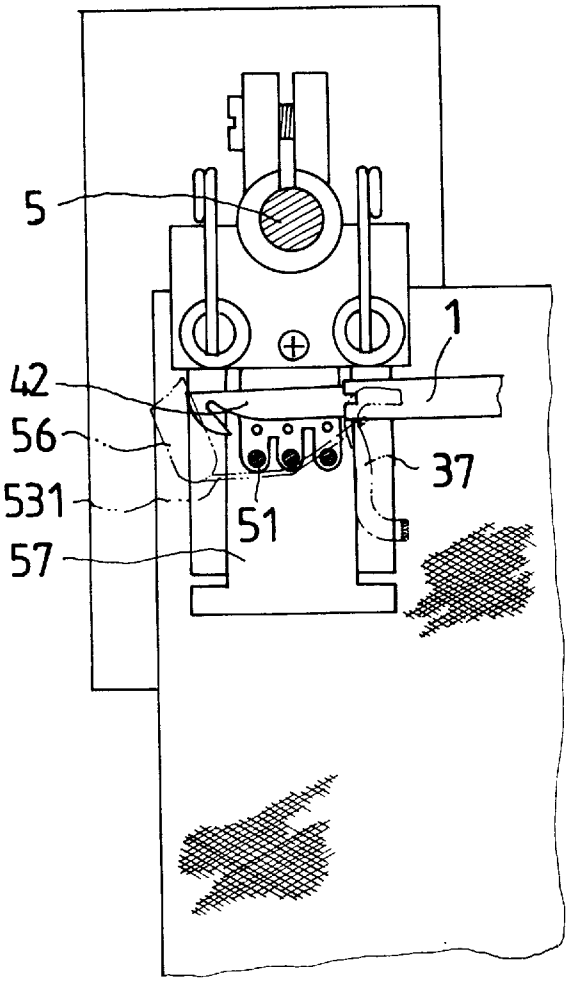
FIG. 6 is another fragmentary top view of the sewing machine with the auxiliary device of the present invention under operation.
Figure 7:
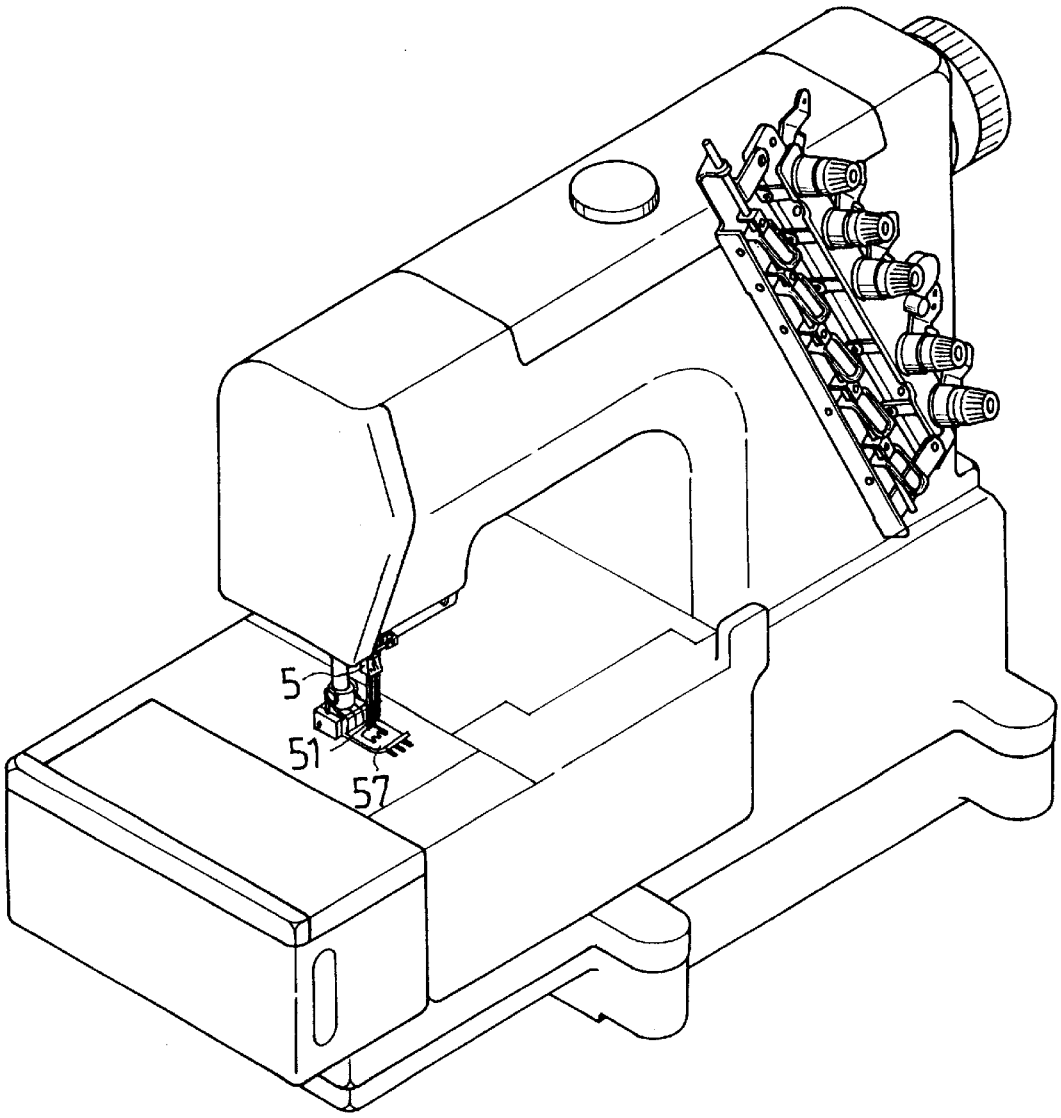
FIG. 7 (PRIOR ART)
FIG. 7 is a perspective view of a conventional sawing machine in the Background.
Figure 8:
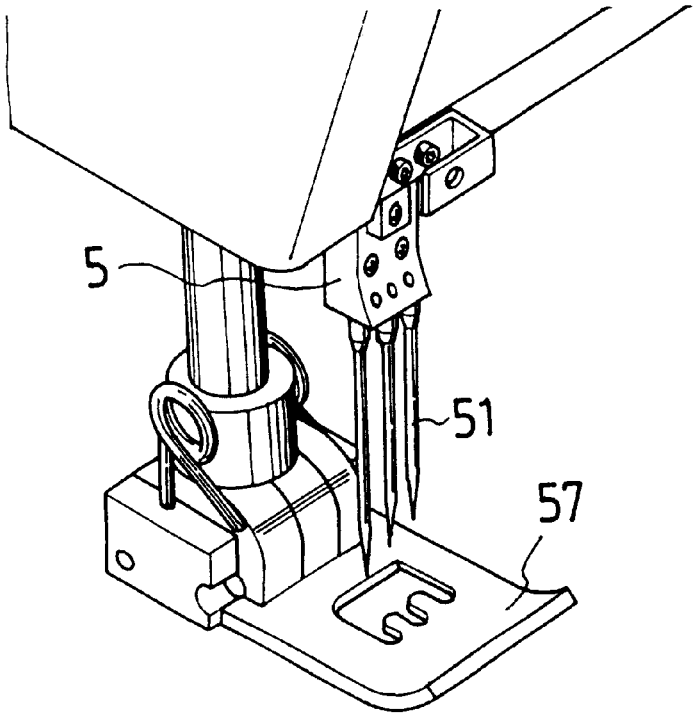
FIG. 8 (PRIOR ART)
FIG. 8 is a fragmentary perspective view of the conventional sawing machine in the Background.
Figure 9:
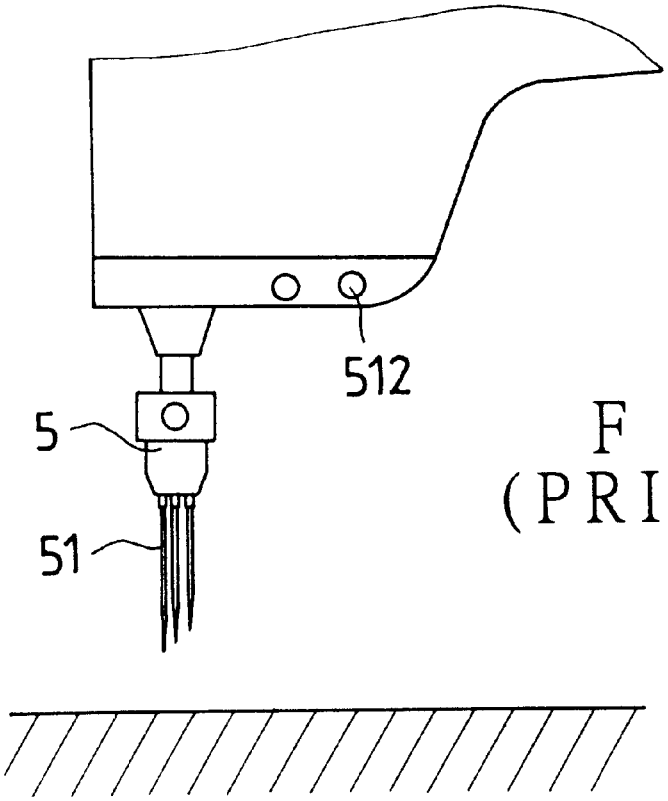
FIG. 9 (PRIOR ART)
FIG. 9 is a front view of the conventional sawing machine in the Background.
Figure 10:
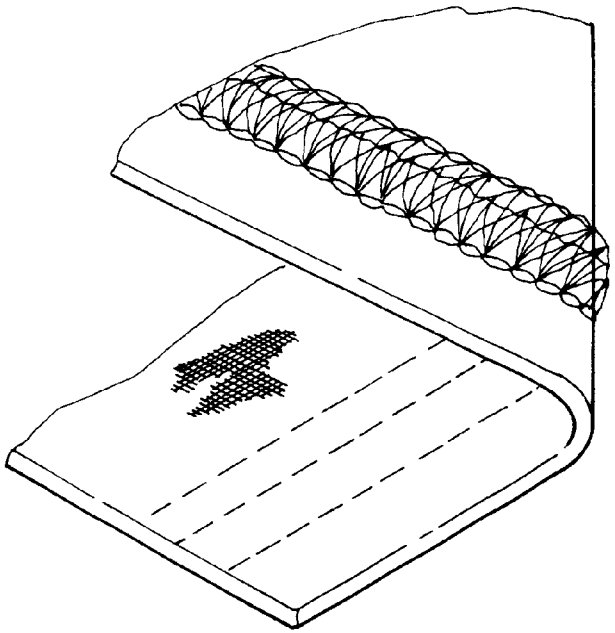
FIG. 10 (PRIOR ART)
FIG. 10 is a view of a cloth with a lower side net-like stitch.
Figure 20:
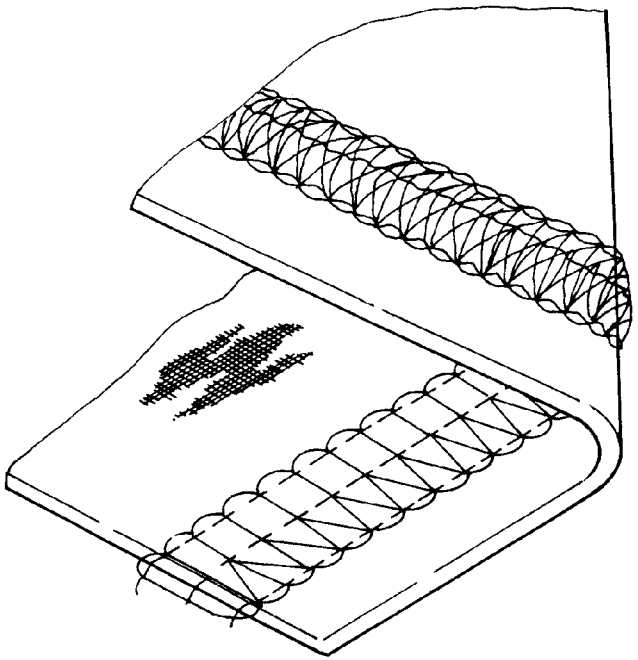
FIG. 20 is a view of a cloth with two-side net-like stitches made with the sewing machine having the auxiliary device of the present invention.
Figure 11:
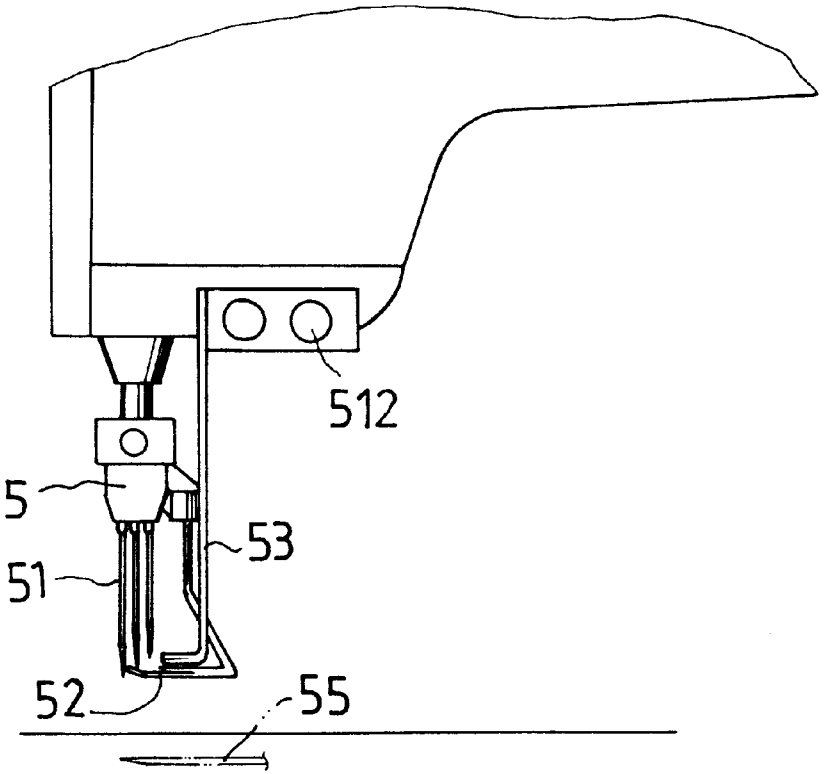
FIG. 11 (PRIOR ART)
FIG. 11 is a side view of a conventional sewing machine of the Background with an upper shuttle and a thread guide.
Figure 12:
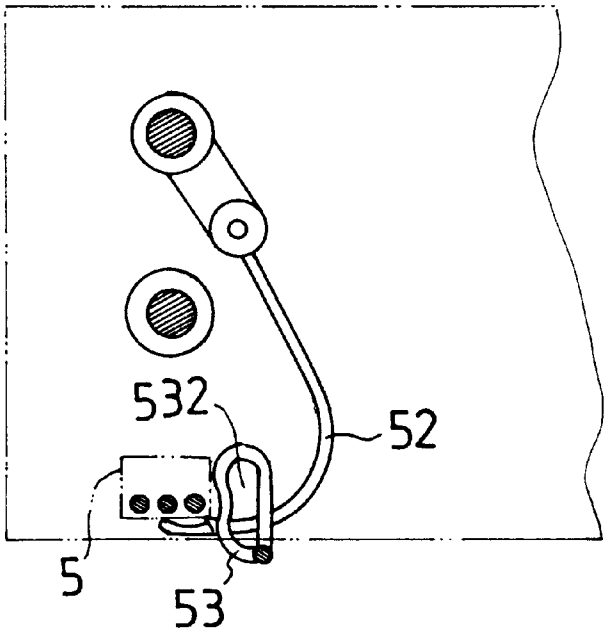
FIG. 12 (PRIOR ART)
FIG. 12 is a top view of some of the parts in FIG. 11.
Figure 14:
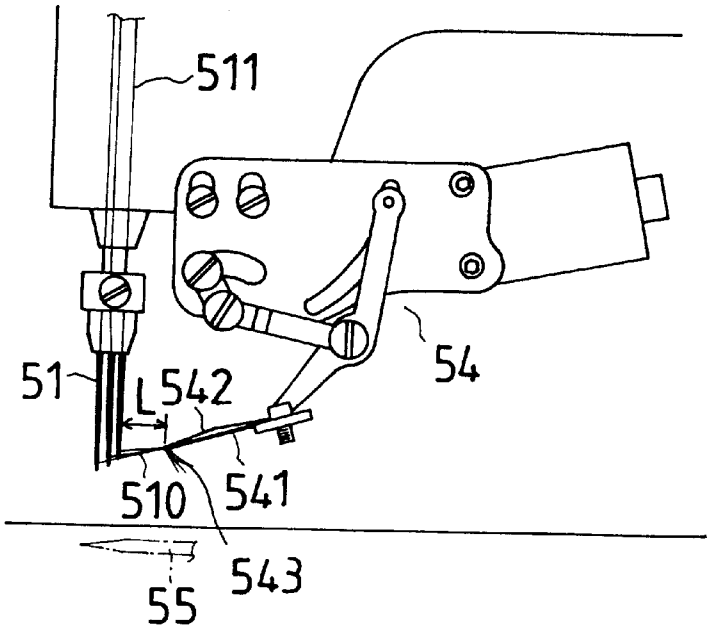
FIG. 14 (PRIOR ART)
FIG. 14 is another view of the parts in FIG. 13 with the upper thread hooking device holding the threads and moved back.
Figure 13:
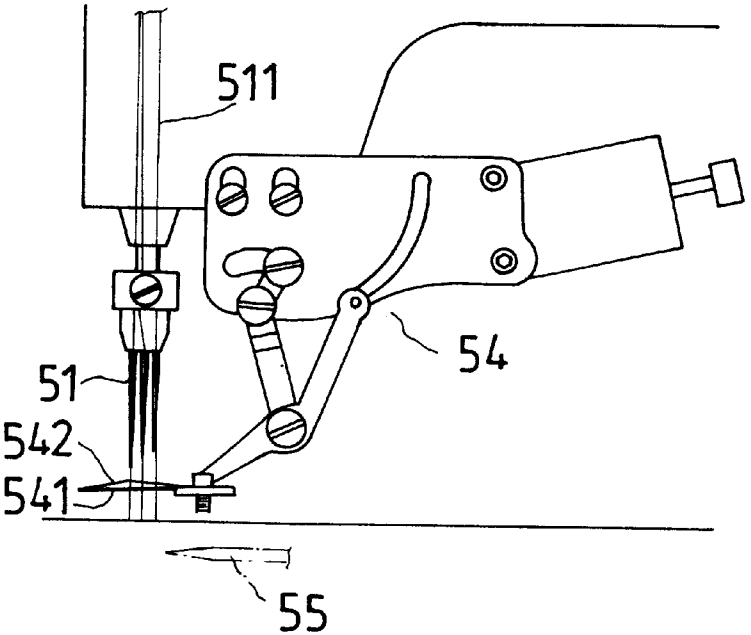
FIG. 13 (PRIOR ART)
FIG. 13 is fragmentary front view of a conventional sewing machine with an upper thread hooking device and a lower cutting device.
Figure 15:
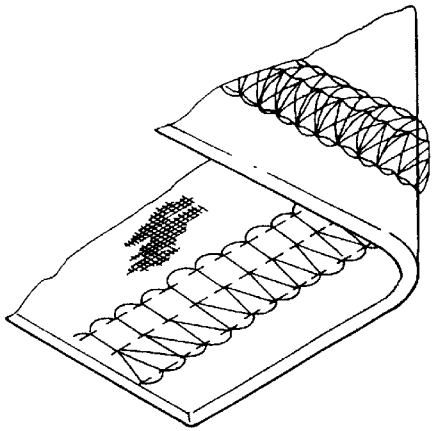
FIG. 15 (PRIOR ART)
FIG. 15 is a view of a cloth with two-side net-like stitches made by means of the conventional sewing machine.
Figure 18:
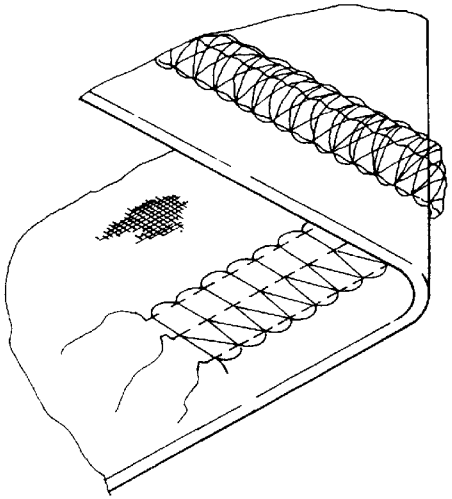
FIG. 18 (PRIOR ART)
FIG. 18 is a view of a cloth with two-side net-like stitches made with a conventional sewing machine, with the first few units of the stitches missing.
Figure 19:
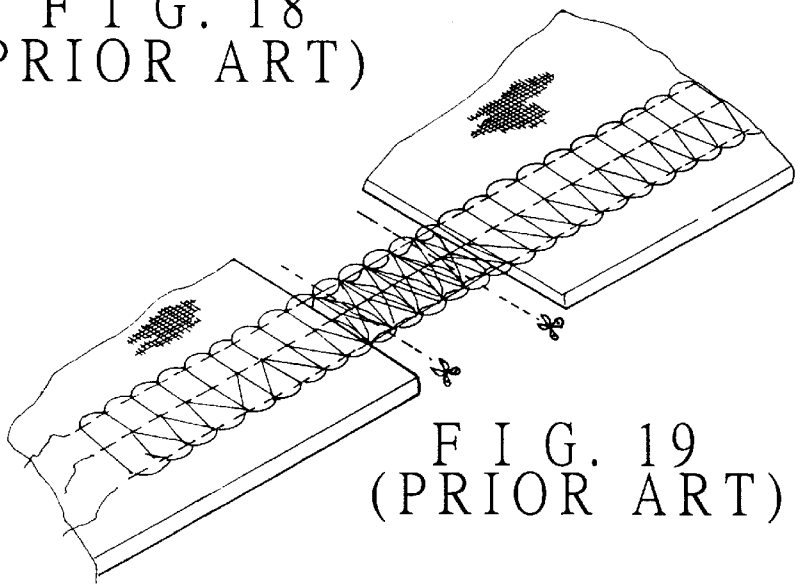
FIG. 19 (PRIOR ART)
FIG. 19 is a view of two cloths with two-side net-like stitches made with a conventional sewing machine.
Figure 16:
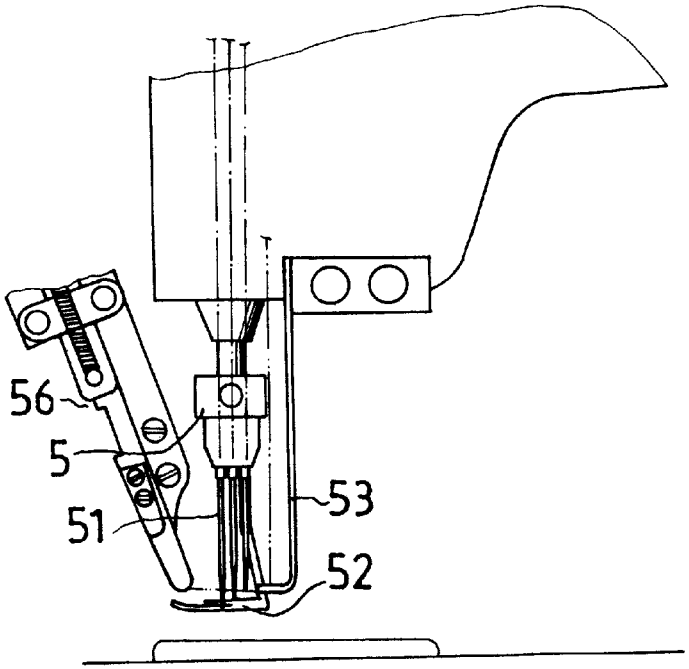
FIG. 16 (PRIOR ART)
FIG. 16 is a fragmentary side view of a conventional sewing machine with an upper thread cutting device, an upper shuttle and a thread guide.
Figure 17:
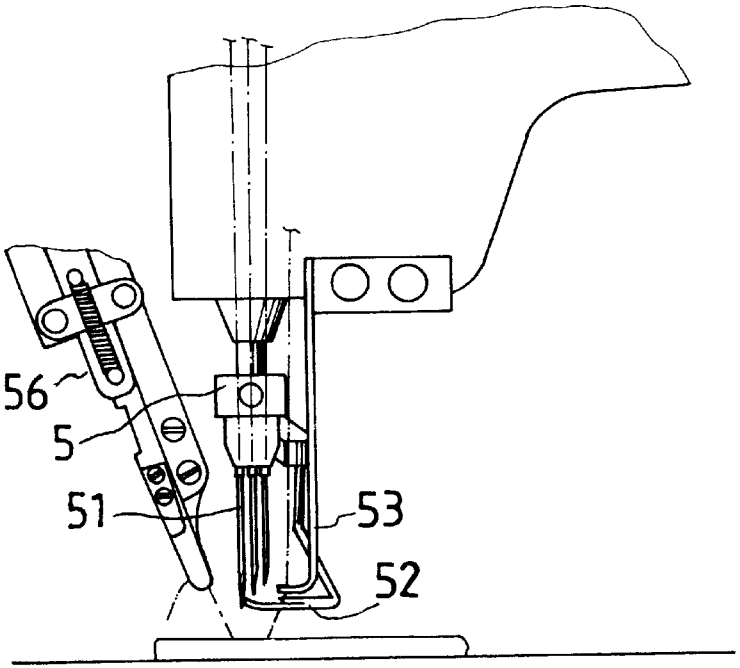
FIG. 17 (PRIOR ART)
FIG. 17 is another fragmentary side view of the conventional sewing machine in FIG. 16.
Figure 21:
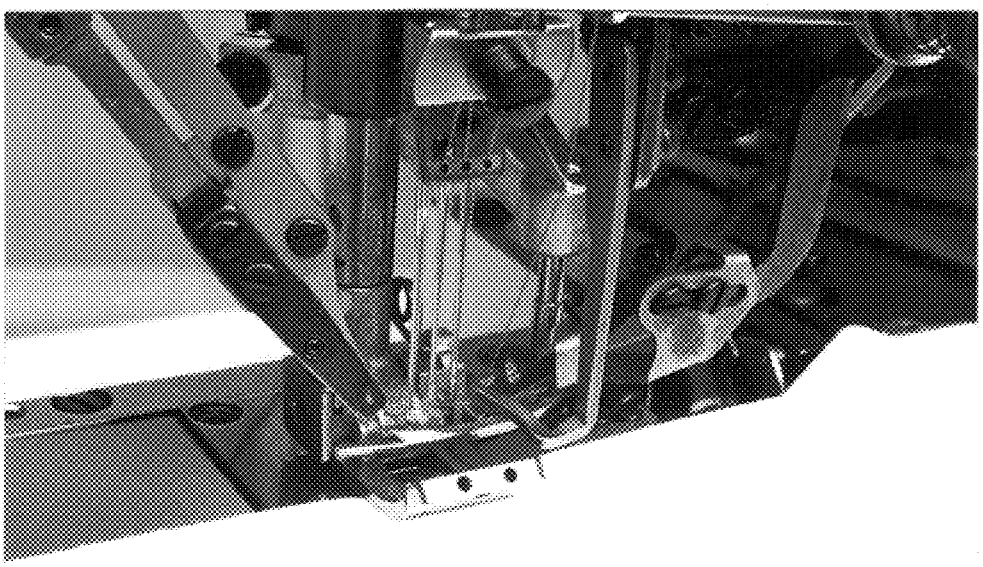
FIG. 21 shows the main part of the sewing machine with the auxiliary device of the present invention.
Figure 22:
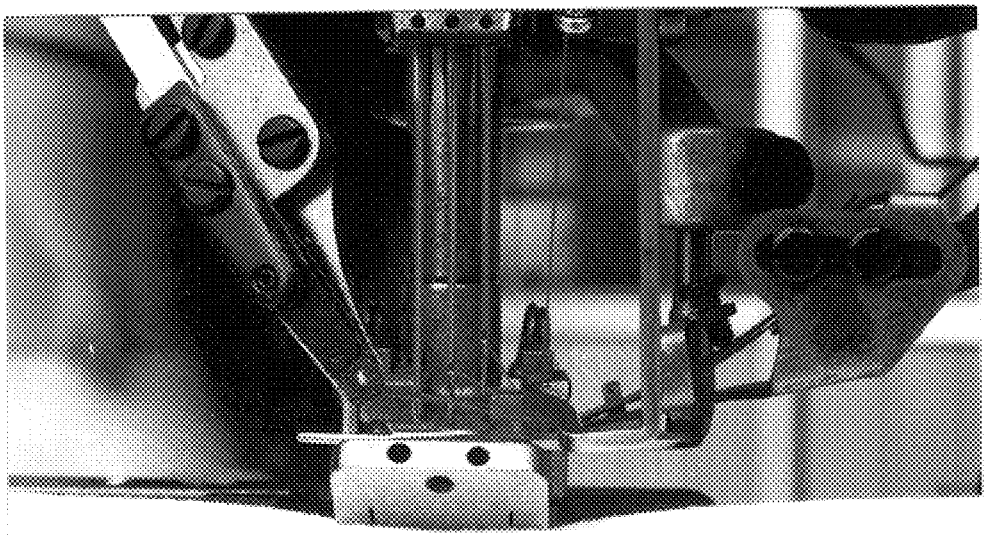
FIG. 22 is a front view of the parts of FIG. 21.
Figure 23:
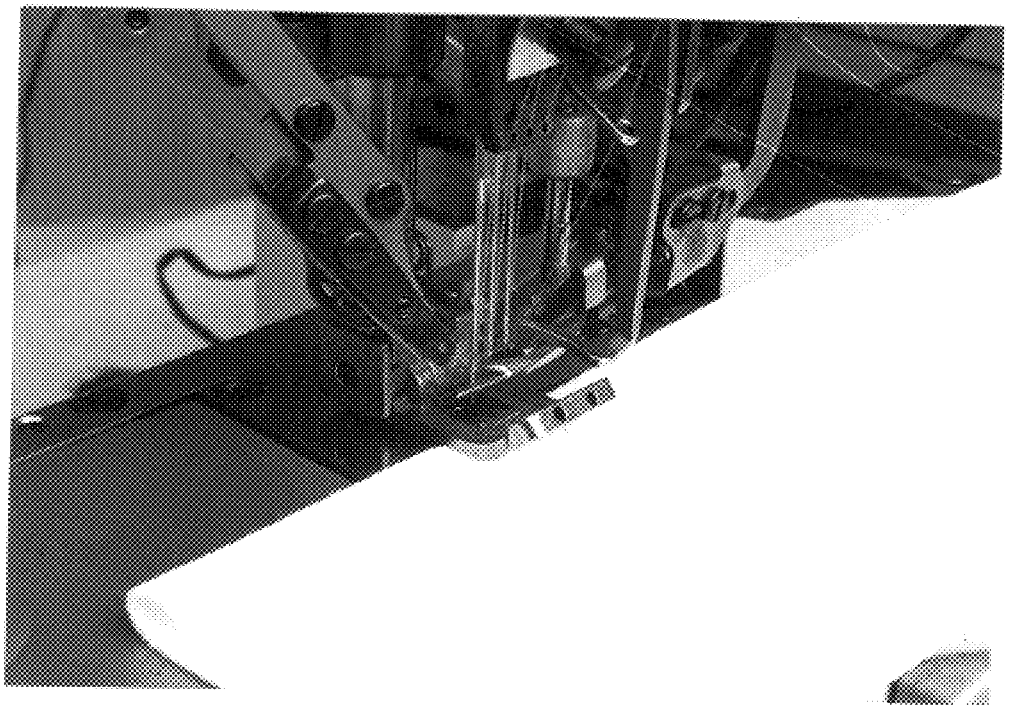
FIG. 23 shows the part of the sewing machine of FIG. 21 under a first step of sewing movement for making two-side net-like stitches.
Figure 24:
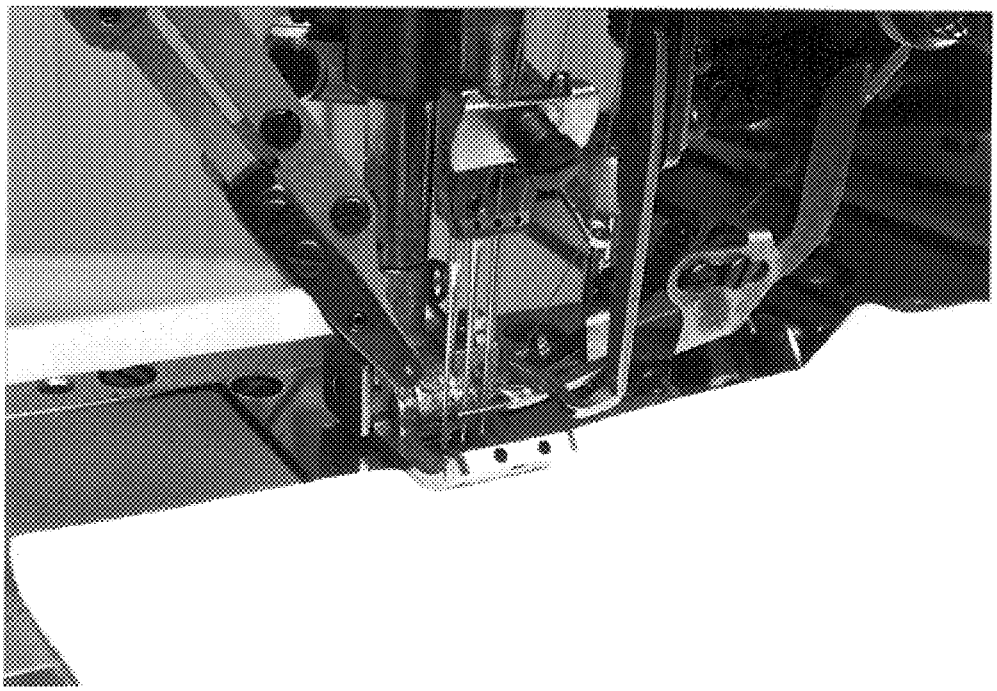
FIG. 24 shows the part of FIG. 21 under a second step of sewing movement for making two-side net-like stitch.
Figure 25:
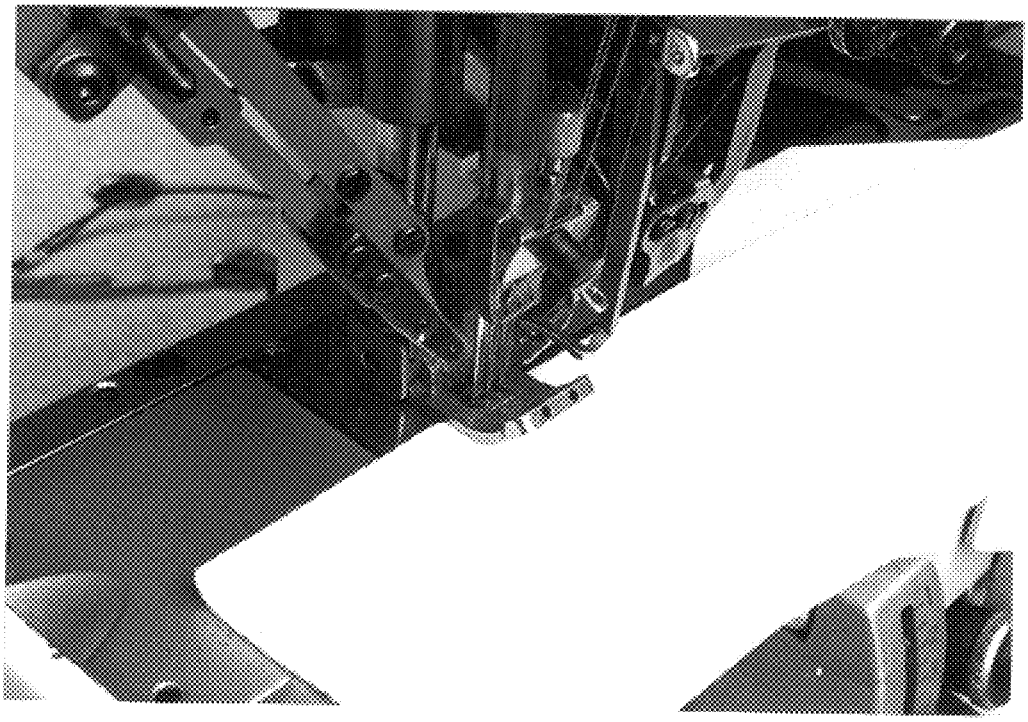
FIG. 25 shows the part of FIG. 21 under a third step of sewing movement for making two-side net-like stitch.
Figure 26:
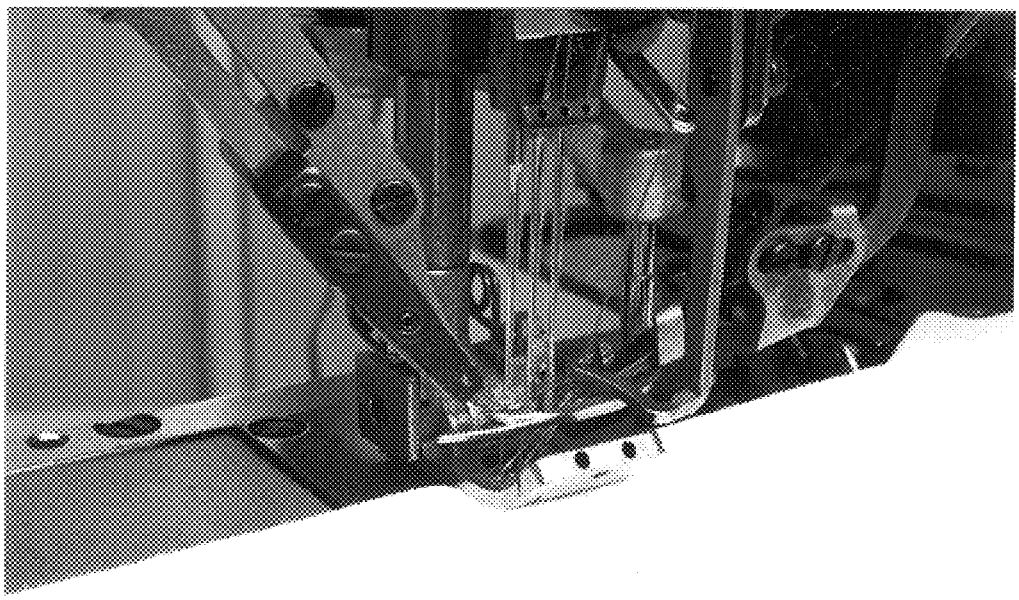
FIG. 26 shows the part of FIG. 21 under a fourth step of sewing movement for making two-side net-like stitch.
Figure 27:
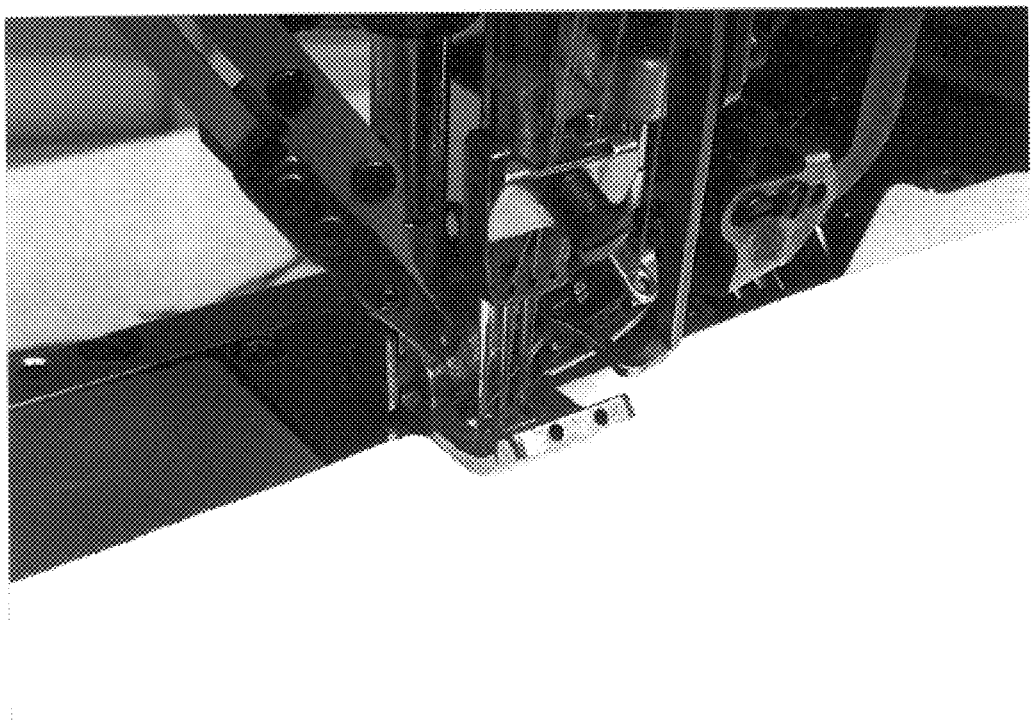
FIG. 27 shows the part of FIG. 21 under a fifth step of sewing movement for making two-side net-like stitch.
Figure 28:
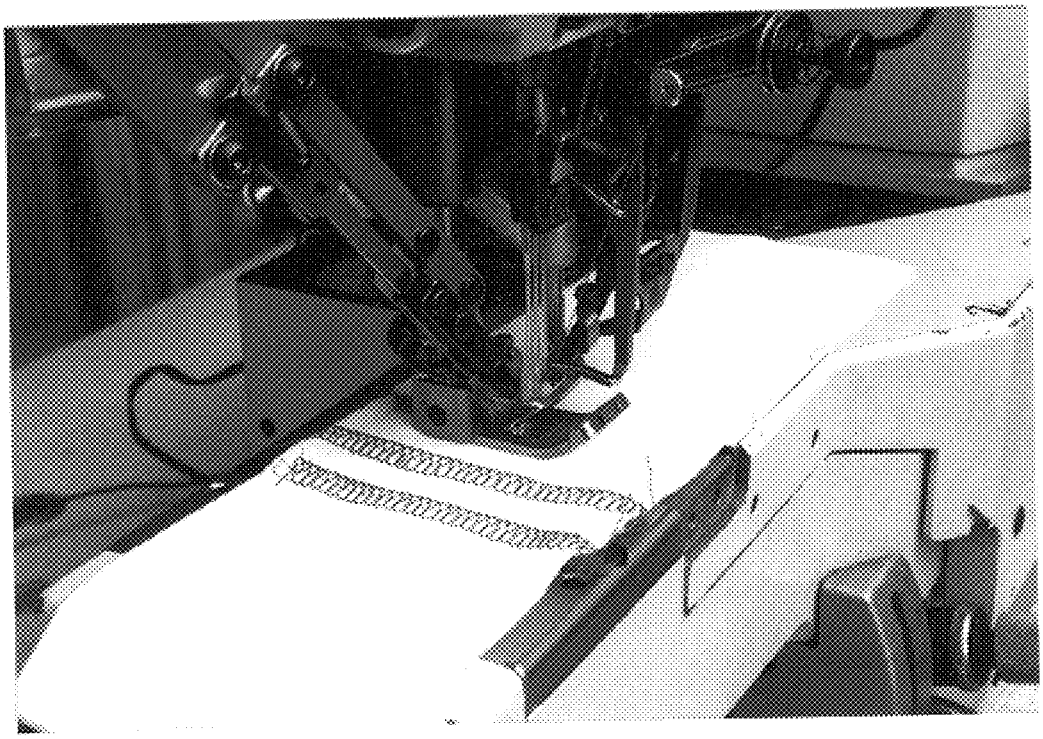
FIG. 28 shows the part of FIG. 21 under a sewing movement and the upper net-like stitch on the cloth.
Figure 29:
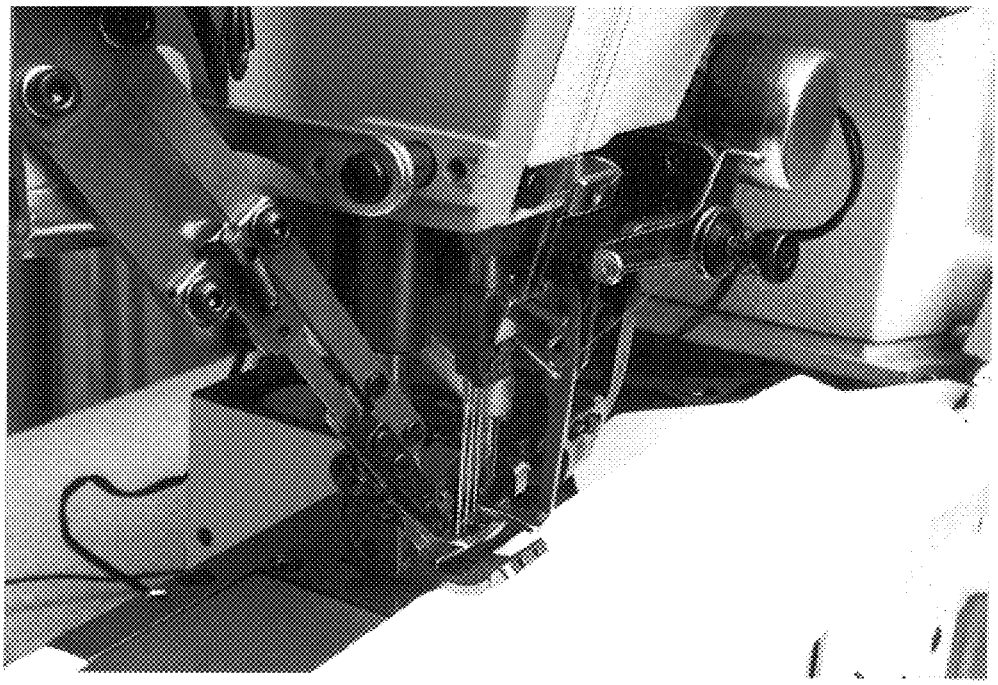
FIG. 29 shows the part of FIG. 21 under sewing movement for making only lower-side net-like stitch.
Figure 30:
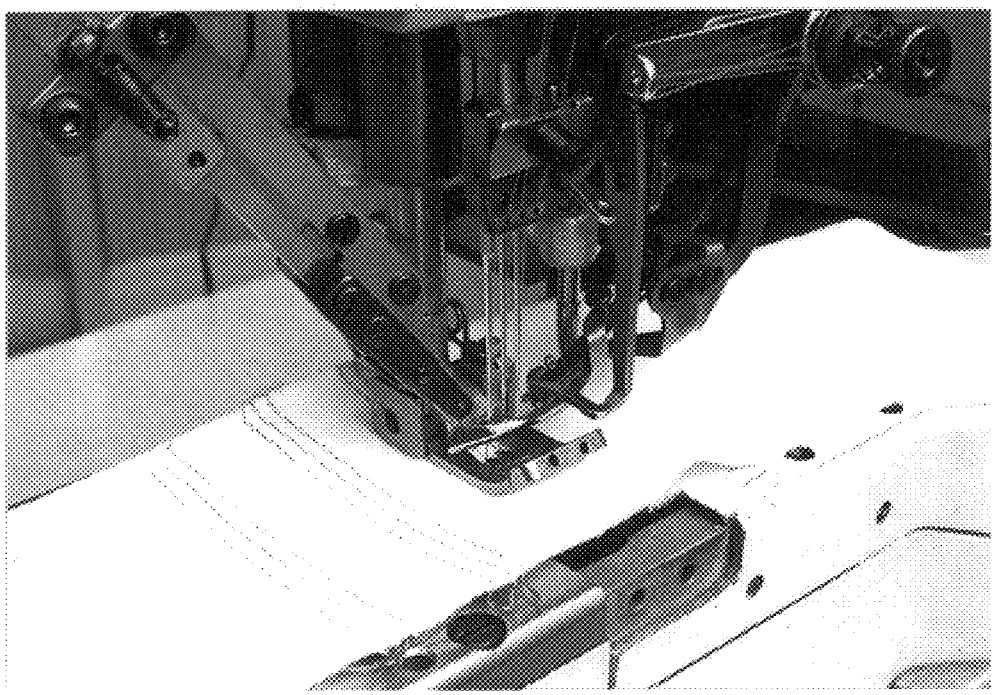
FIG. 30 shows the part of FIG. 21 under sewing movement and the cloth with only lower-side net-like stitch.
Figure 31:
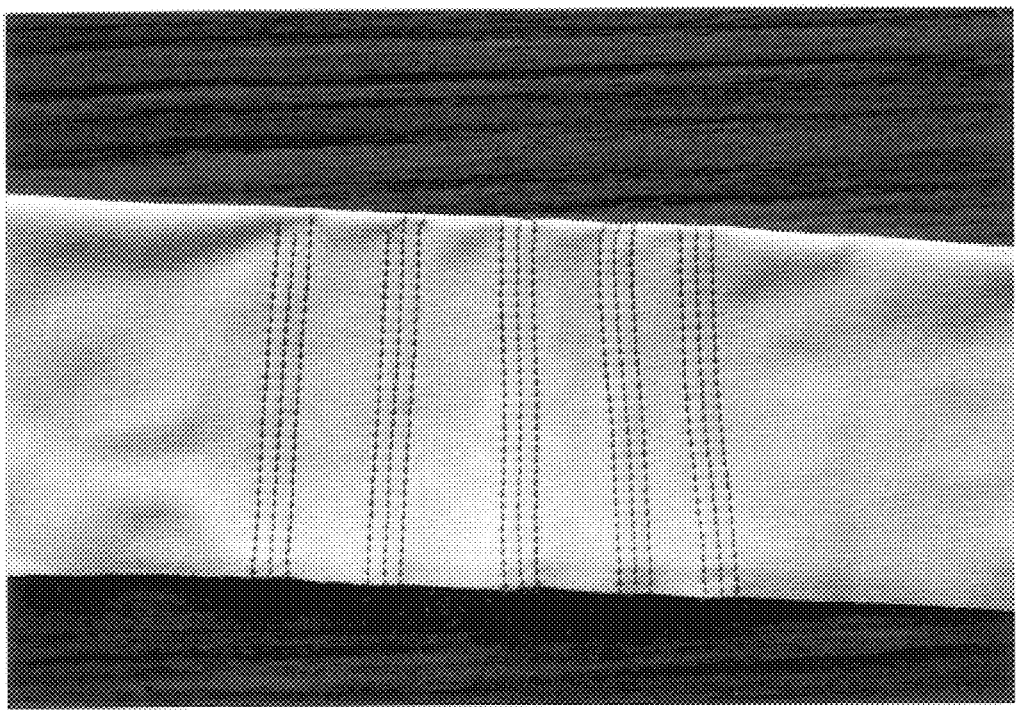
FIG. 31 shows a cloth with the upper-side straight stitches made by the sewing machine of the present invention.
Figure 32:
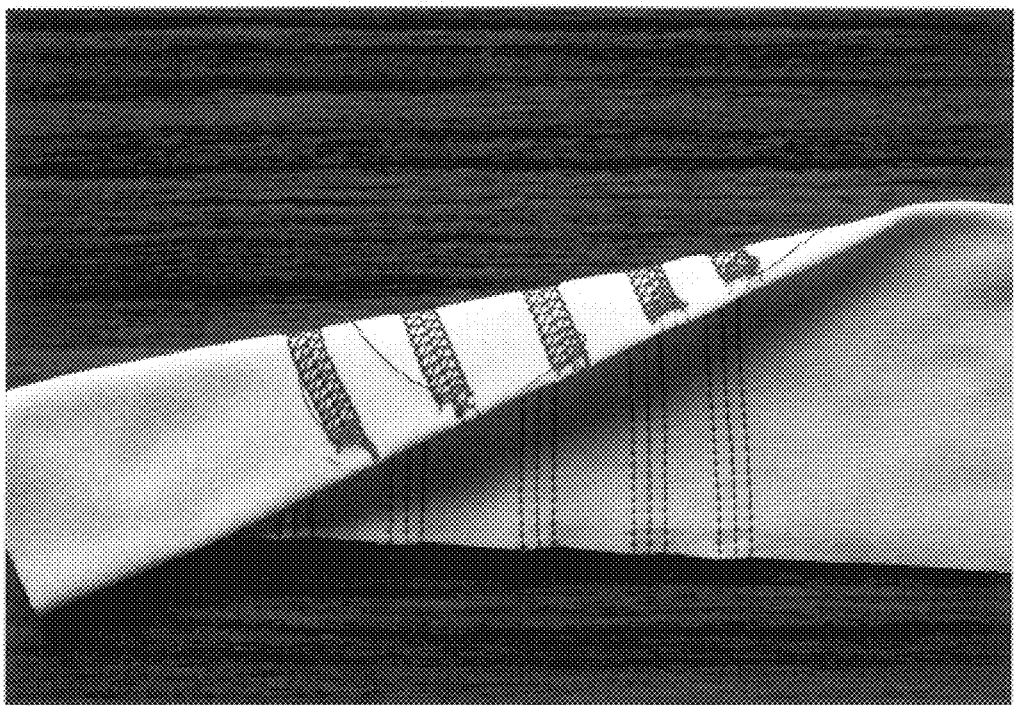
FIG. 32 shows the cloth of FIG. 31 and the lower-side net-like stitch made by the sewing machine of the present invention.
Figure 33:
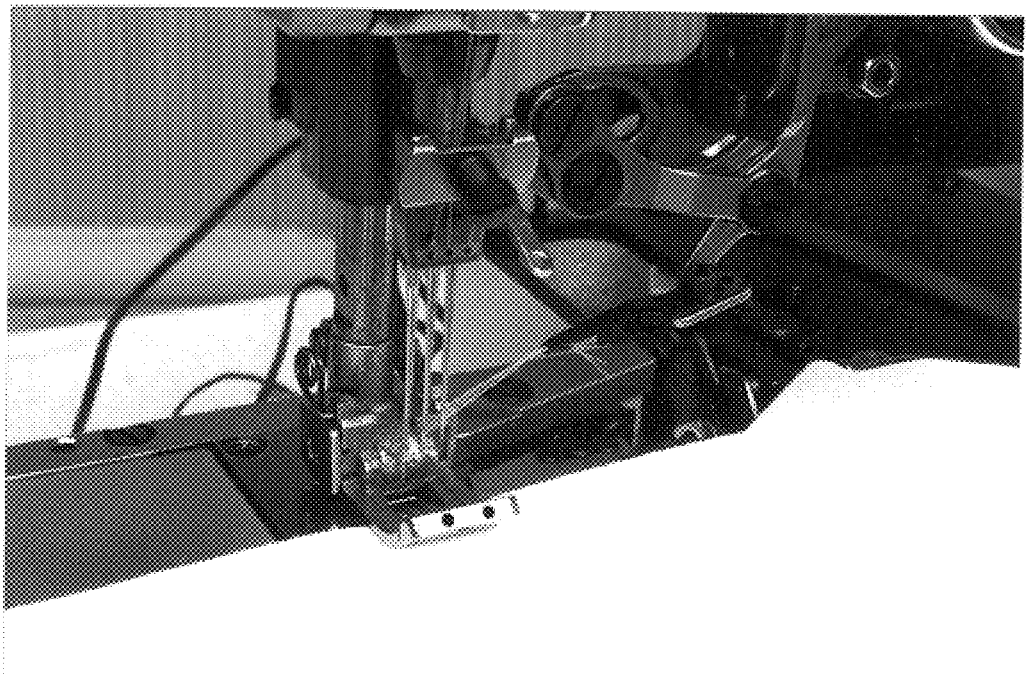
FIG. 33 shows the conventional sewing machine capable of only making lower-side net-like stitch and the conventional upper hooking device.
Figure 34:
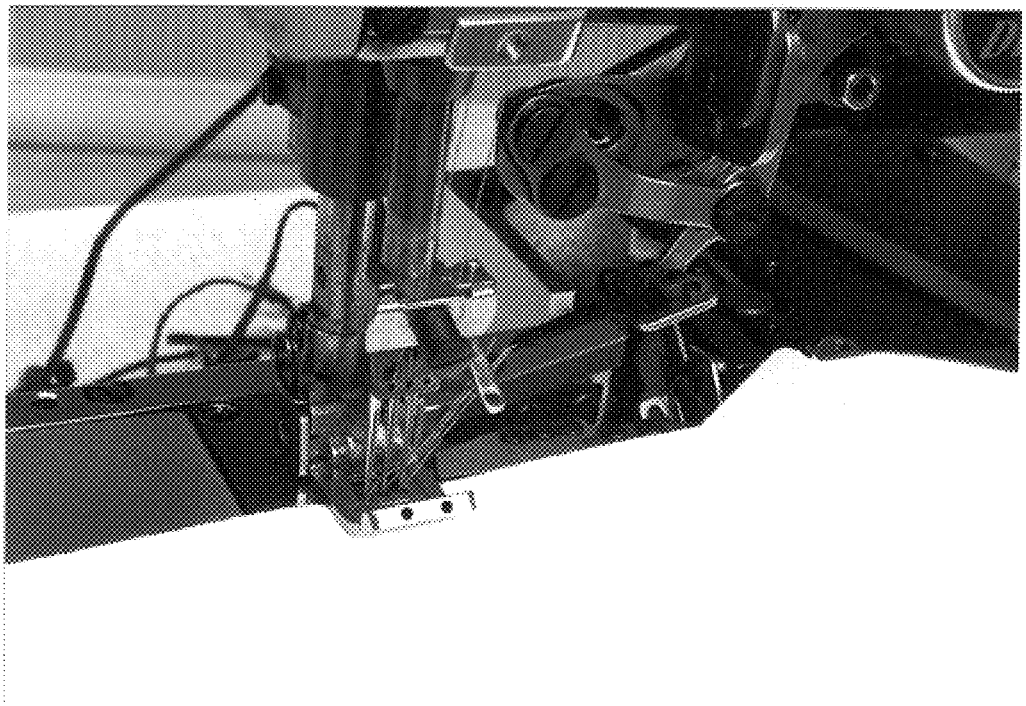
FIG. 34 shows the sewing machine of FIG. 33 with the threads falling off the hooking device under sewing movement.
Figure 35:
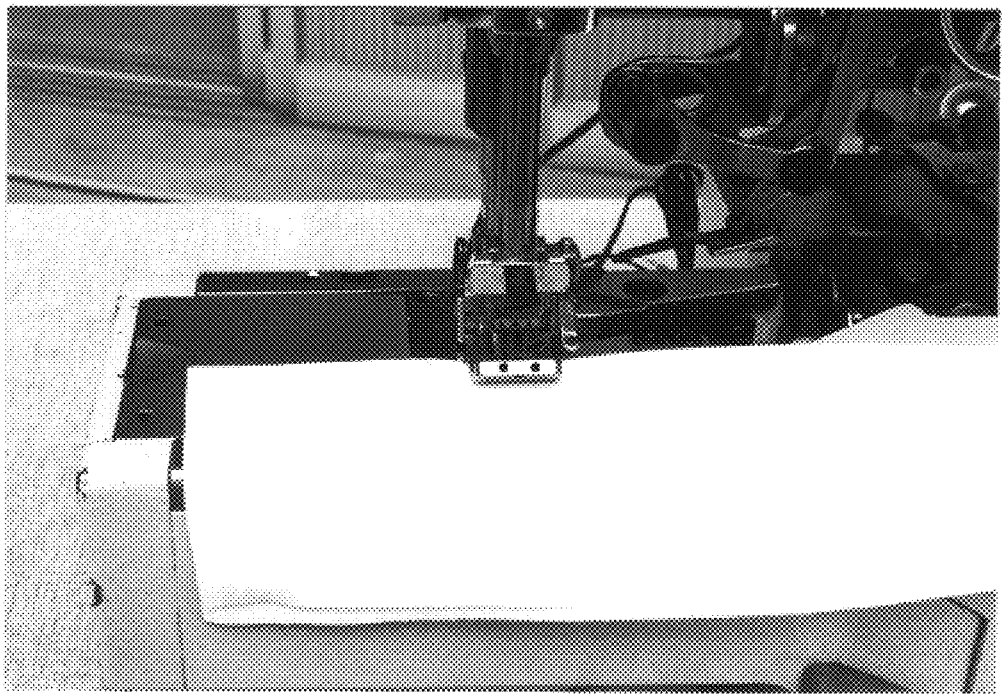
FIG. 35 shows the sewing machine of FIG. 33 under sewing movement from the front side.
Figure 36:
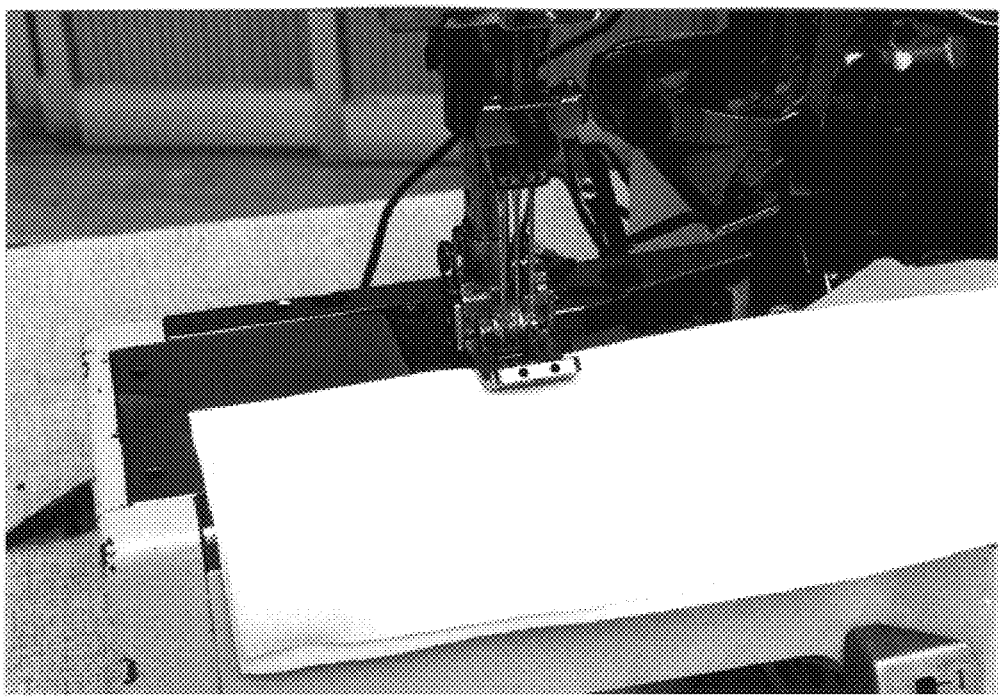
FIG. 36 shows the sewing machine of FIG. 35 under sewing movement.
Figure 37:
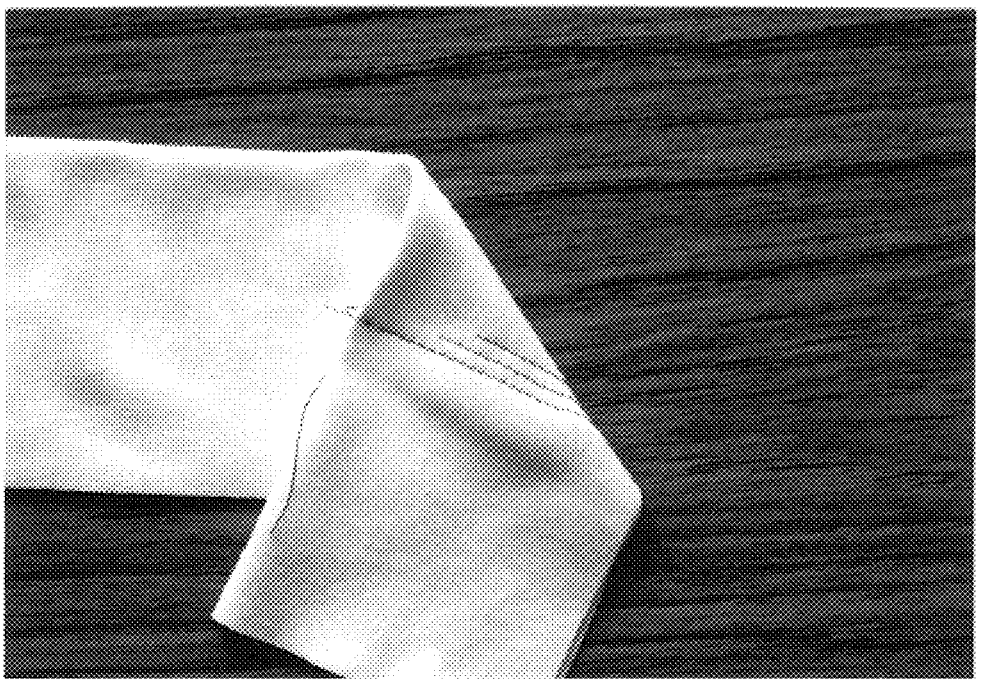
FIG. 37 shows the cloth of the sewing movement of FIGS. 35 and 36 with upper-side straight stitches failing to form appropriately.
Figure 38:
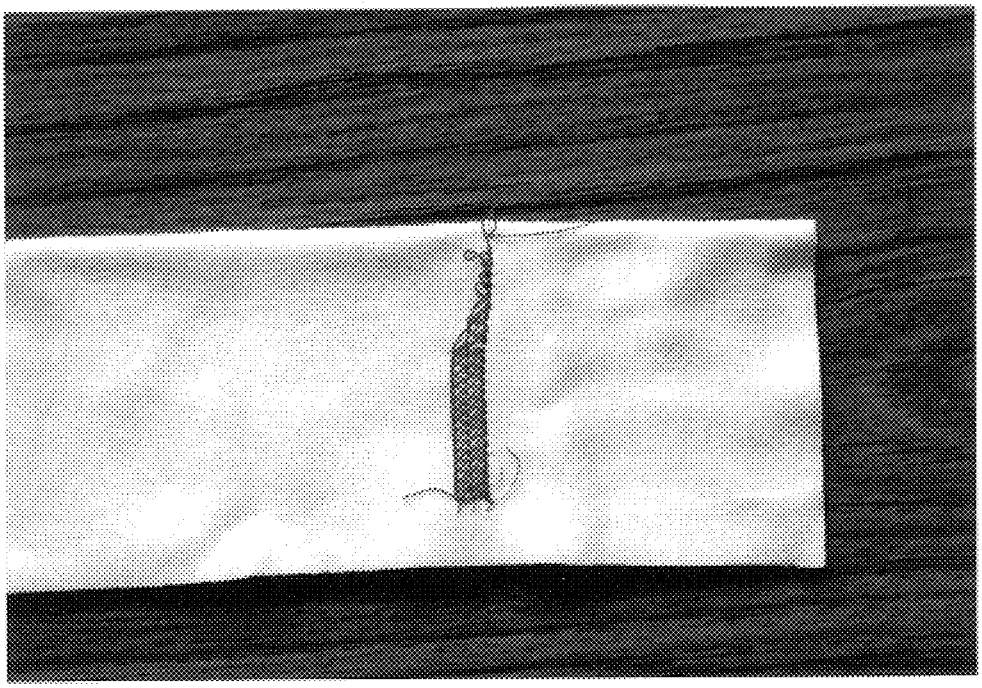
FIG. 38 shows the cloth of FIG. 37 with the lower-side net-like stitches failing to form appropriately.

Referring to FIGS. 5 and 6, the sewing machine further has an upper thread cutting device like the conventional one which will cut off the net thread 531 at the end of sewing, and hold the end of the net thread 531 in position such that the net thread 531 can form net-like stitches easily by means of the shuttle 52 and the threads 511 at the beginning of sewing of the next cloth.

The thread hooking device 4 is an improvement on the one 54 with R.O.C. patent no. 288691; the hook plate 42 of the present invention doesn't have an elastic plate 542 of the hooking device 54 such that same can smoothly and easily move backwards and forwards between the clipping end portion 11 and 21 of the lower clipping plate 1 and the lower clipping member 2.

In making three straight stitches and one net-like stitch on each side of a cloth with the sewing machine, the first kind of threads 511 will be hooked and pulled into between the clipping end portion 11 and 21 when the lower cutting device 55 cuts off same such that the ends of the threads 511 are held in position. The confining gaps 14 and 27 of the clipping end portions 11 and 21 can confine the end portions of the threads 511 therein such that the threads will not move sideways to a wrong place. The confining protrusion 20 of the lower clipping member 2 also prevents the threads 511 from moving out. In sewing, the upper shuttle 52 moves forwards, and the needles 51 move down, so the net thread 531 will stand between the first (right) one of the needles 51 and the thread of the first needle, and be secured to the cloth. Then, the upper shuttle 52 continues to move forwards till end, and begins to move backwards, placing the net thread 531 between the third (left) needle and the thread of the third needle for same to be secured to the cloth. The shuttle 52 makes the net thread 531 form U shapes on the cloth over and over again in order to make net-like stitch. The movement of the upper shuttle 52 and the needles 51 are same as that of the prior art, so it is not further detailed here.

The upper cutting device 56 also cut off the net thread 531, and hold the end of the thread 531 in position at the end of sewing a first cloth such that the following clothes can be sewed with the net-like stitches securely formed at the very beginning.

The clipping end portions 11 and 21 of the upper clipping plate and the lower clipping member 2 are disposed under, and very close to , the left side of the curved hook portion 37 of the thread guide 3, and also very close to the ends of the needles 51; the length of each of the end portions of the threads 511 is about 3 to 5 centimeters such that the end portions of the threads 511 held between the clipping end portions 11 and 21, although become shorter, would not fail out when the needles 51 move down in sewing.

To make net-like stitch only on a lower side of a cloth with the sewing machine of the present invention, the net thread 531 is removed. The auxiliary device of the present invention can hold the end portions of the threads 511 of relatively long length as compared with the conventional upper hooking device 54 which used the hooking plate 541 and the elastic plate 542; thus, the drawback of failing to form three to four units of the net-like stitch to overcome.

From the above description, the auxiliary device of a sewing machine of the present invention can be known to have desirable features as follows:

1. Net-like stitches can be securely made on two sides of a cloth at the same time without having to install many components on a conventional sewing machine.

2. With the clipping end portions of the auxiliary device, the threads won't fall out to a wrong position at the beginning of sewing, i.e. the drawback of several units of the net-like stitches failing to form is overcome.

3. The sewing machine can make net-like stitches on one side or two sides of a cloth with the same auxiliary device fitted thereto. Therefore, there is no calibration problem.

4. The workers no longer have to move the threads to a correct place in sewing.

5. The tightness between the clipping end portion can be adjusted to a suitable degree, especially when the thread tightness has been changed.

What is claimed is:

1. An auxiliary device of a sewing machine, comprising an upper clipping plate connected to a lower clipping member with a hooked plate movable inserted between a clipping end portion of said upper clipping plate and a clipping end portion of said lower clipping member; said clipping end portions each having a confining gap at a front end; said hooked plate pulling three first kind of threads into between said clipping end portions for same to be held by said clipping end portions with said confining gaps preventing same from falling out when said first threads are cut off from a cloth to be sewed with net-like stitch; said front end confining gaps of said clipping end portions being disposed close to needles of said first threads, and under a curved hook portion of a thread guide of a net thread provided for making said net-like stitch in order to present said first threads from falling off said clipping end portions when said needles of said first threads move down in sewing.

2. The auxiliary device of a sewing machine as claimed in claim 1, wherein said thread guide is connected to said sewing machine by means of an angle plate such that there is space for said upper clipping plate and said lower clipping member disposed under said curved hook portion of said thread guide.

3. The auxiliary device of a sewing machine as claimed in claim 1, wherein, said upper clipping plate has a curved portion, and said lower clipping member has an adjustment screw being screwed through a bent plate on one side of said lower clipping member to contact said curved portion for changing a tightness between said upper clipping plate and said lower clipping member.

4. The auxiliary device of a sewing machine as claimed in claim 1, wherein said lower clipping member has a connecting end portion at an opposite end of said clipping end portion for same to be connected to said sewing machine.

5. The auxiliary device of a sewing machine as claimed in claim 1, wherein said lower clipping member has a confining protrusion sticking up from one side thereof to prevent said first threads from falling out.

6. The auxiliary device of a sewing machine as claimed in claim 1, wherein said thread guide has a gap opposing said curved hook portion for permitting said clipping end portions to be passed thereinto.

* * * * *